United States Patent [19]

Gazzarrini

[11] Patent Number: 4,954,045

[45] Date of Patent: Sep. 4, 1990

[54] APPARATUS AND METHOD FOR TRANSFERRING ARTICLES FROM A SEWING MACHINE

[75] Inventor: Vinicio Gazzarrini, Florence, Italy

[73] Assignee: Solis S.r.l., Florence, Italy

[21] Appl. No.: 259,039

[22] Filed: Oct. 17, 1988

[30] Foreign Application Priority Data

Oct. 16, 1987 [IT] Italy ..... 9511-A/87

[51] Int. Cl.[5] ..... D05B 21/00

[52] U.S. Cl. ..... 414/792.7; 112/121.15; 414/789.9; 271/175; 271/267

[58] Field of Search ..... 414/13, 26, 27, 793, 414/790.1; 112/121.15, 121.29; 271/175

[56] References Cited

U.S. PATENT DOCUMENTS

| | | | |
|---|---|---|---|
| 3,951,400 | 4/1976 | Blessing et al. | 112/121.29 X |
| 4,303,026 | 12/1981 | Ueda | 112/121.15 |
| 4,649,838 | 3/1987 | Gazzarrini | 112/121.15 |
| 4,784,070 | 11/1988 | Thurner et al. | 112/121.15 X |

FOREIGN PATENT DOCUMENTS

| | | | |
|---|---|---|---|
| 2122654 | 1/1984 | United Kingdom | 112/121.15 |
| 0135644 | 4/1985 | European Pat. Off. | 112/121.15 |
| 2627006 | 12/1977 | Fed. Rep. of Germany | 112/121.29 |

*Primary Examiner*—Robert J. Spar
*Assistant Examiner*—James T. Eller, Jr.
*Attorney, Agent, or Firm*—McGlew & Tuttle

[57] ABSTRACT

A device to automatically transfer pantyhose articles from a sewing machine to a conveyor for packed pantyhose articles includes a carriage 2 reciprocable on a horizontal track 10 extending from an unloading station of a sewing machine (LC) to a loading station of a conveyor (BG) for packed pantyhose articles. Grippers having flat horizontal tips, one being fixed, the other being vertically movable, hold an elastic band 40 of a pantyhose article when the bodice is fitted over the sewing forms 9 of the sewing machine. A stylus is associated with and extends parallel to the tips of the gripper 3 and is movable in a direction perpendicular thereto to rotate the bodice of the pantyhose. The gripper engages the pantyhose while it moves through approximately 90° about its own horizontal axis in order to make the seams of the pantyhose coincide over the same vertical median plane. A rotator 6–9 acts to rotate the gripper 3 and the stylus 5 through approximately 90° about a horizontal axis with the pantyhose being made to hang during down the forward run of the carriage 2 in order to orientate and lay the elastic band of the bodice on one side of an underylying vertical shelf 12 of a pg,2 conveyor (BG) for packing pantyhose articles and the disjoined legs of the pantyhose become engaged on the other side of a shelf 12 located above the conveyor BG and thus causing them to make part of a pack (P) of pantyhose articles.

13 Claims, 9 Drawing Sheets

LC

BG
P
P
1
2
3
4
5
6
7
8
9
10
12
21
32
33
40
51
52
53
55
70

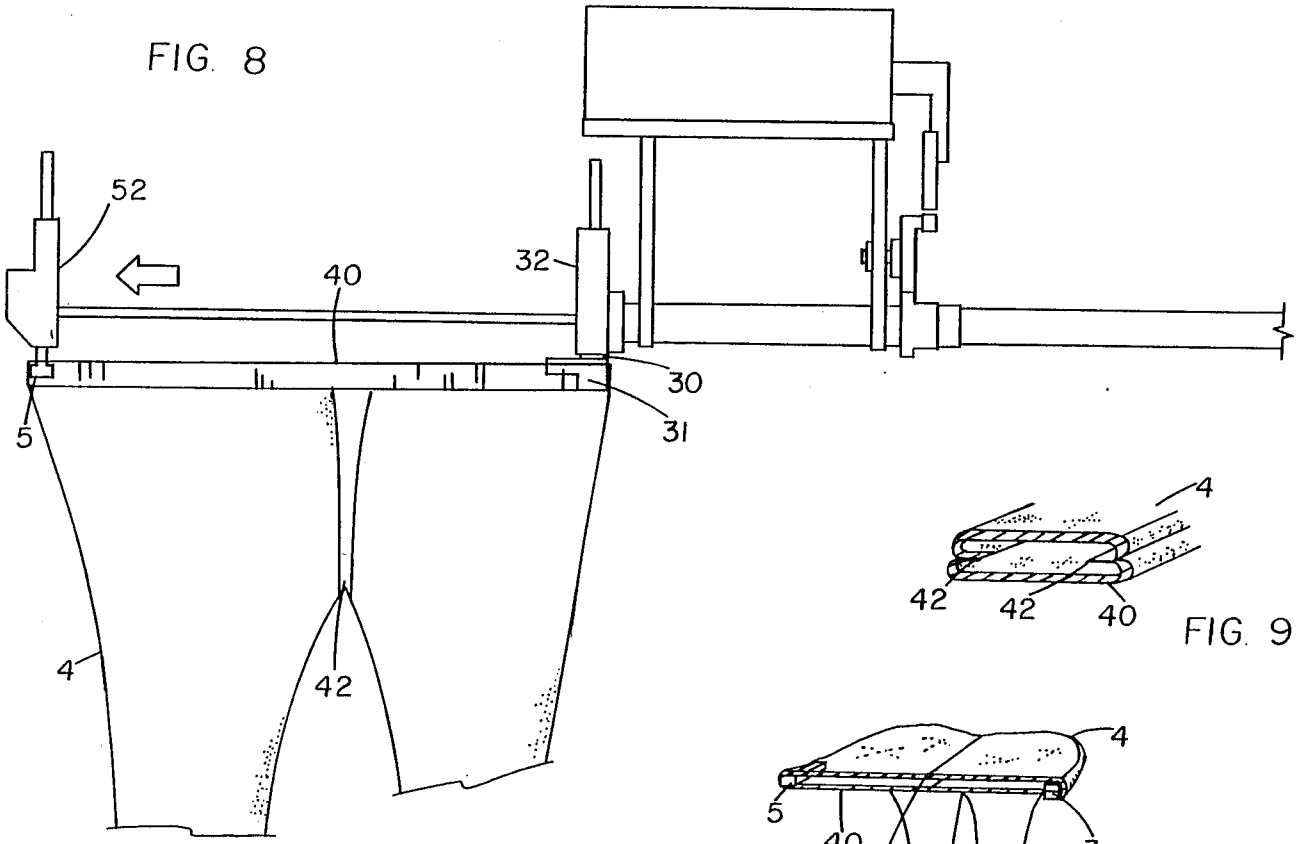
FIG. 8
FIG. 9
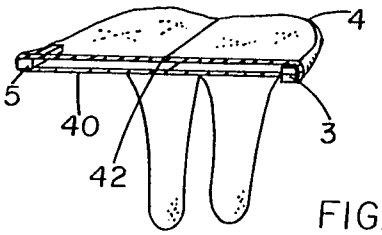
FIG. 10

APPARATUS AND METHOD FOR TRANSFERRING ARTICLES FROM A SEWING MACHINE

BACKGROUND OF THE INVENTION

FIELD OF THE INVENTION

The present invention refers to sewing machine transferring devices and, in particular, to a new and useful apparatus for automatically transferring pantyhose or similar articles produced by a panty-hose sewing machine to a conveyor for packed pantyhose articles.

Italian patent No. 9491-A/87 discloses an automatic pantyhose conveyor for transferring the pantyhose articles from a first to a second group of pantyhose finishing machines. The device includes a conveyor, for example rectilinear, provided with horizontal belts and exhibiting bidirectional intermittent motion. It comprises loading station corresponding to the unloading station of at least a machine of a first group, with an unloading station in correspondence with at least a machine of a second group and with more equidistant intermediate dwell stations. Each station is provided with a support for a pack of superposed and equally oriented pantyhose articles, which support is vertically movable to take up two positions; one emerging from the conveyor to allow the loading, unloading and dwell of a relevant pack, and the other disappearing under the conveyor to allow the laying of a pack onto the conveyor and the successive handling thereof. Each loading station is provided with a shelf articulated so as to result in a vertical and overhead position with respect to the conveyor upon the forming of a pack, and respectively in horizontal and out-of-conveyor position upon the laying of a pack onto the relevant belts.

SUMMARY OF THE INVENTION

The present invention provides an automatic apparatus able to individually pick up the pantyhose articles in the unloading station of a pantyhose-sewing machine and to transfer them in a pendent attitude out of the machine, orient them into a predetermined position, and lay them down to form a pack on the shelf provided in a loading station of the conveyor for packed pantyhose articles.

This result has been achieved, according to the invention, by utilizing: gripper means to enter the pantyhose opening delimited by the pantyhose elastic band while the bodice is still fitting the shapes of the pantyhose-sewing machine and to seize the pantyhose elastic band at only one point. The gripper means moves the pantyhose bodice away from the sewing machine shapes and flattens the elastic edge by stretching it horizontally and orienting it so as to make the seams lay on the same vertical, that is, median plane. The gripper means rotate the pantyhose bodice around a horizontal axis with the elastic edge stretched and oriented while transferring the pantyhose in pendent attitude towards and up to a loading station of a conveyor for packed pantyhose articles. The gripper means move through a path so as to lay the pantyhose on the conveyor with the elastic edge on one side of a vertical shelf of the conveyor for packed pantyhose articles, and with the disjoined leges on the other side of the same shelf.

The advantages obtained thanks to the invention lie in the fact that it is possible to pick up automatically the pantyhose articles from a pantyhose-sewing machine, with or without stopping the sewing machine. Thus, it is possible to supply a conveyor for packed pantyhose articles with the same rate as the operating rate of the sewing machine. It is possible to use two equal devices which, by picking up the pantyhose articles from two corresponding pantyhose-sewing machines, simultaneously supply a same conveyor for packed pantyhose articles.

Accordingly, it is an object of the invention to provide a device for transferring articles, such as a pantyhose from a machine for sewing the articles to a packing station which comprises a stacking location located below a substantially vertically extending shelf and which includes a carriage which is movable between the machine and the shelf so that articles which are engaged by an article gripper on the carriage along with a stylus which is movable relative to the gripper on the carriage so that the article is picked up and rotated with the carriage about a substantially horizonal axis leaving a portion trailing from an elastic band of the article to engage the shelf and become draped over the shelf so that the articles are released at the packing station and may be accumulated thereon in a stack.

A further object of the invention is to provide a method of stacking pantyhose after they have been sewn on a sewing machine and using a movable gripper and stylus on a carriage to a packing location and which comprises engaging the article by causing one tip of a gripper to enter into the waistband of the article and the other to engage over the top of the waistband, moving a stylus outwardly of the gripper so that the article is spread apart laterally, moving a carriage with the gripper and the stylus to carry the article to a packing location, causing the article to intercept a substantially vertically oriented shelf so that the grip portion is moved over the shelf and the remaining portion is draped over the shelf, and withdrawing the shelf so as to position the article at the packing location.

A further object of the invention is to provide a device for transferring articles from a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE DRAWINGS

In the drawings:

FIG. 8 is a side elevational view showing the spreading apart of the article;

FIG. 9 is a partial perspective view of the article to be transferred after it has been sewn; and FIG. 10 is a view similar to FIG. 9 after the waistband portion has been spread apart;

GENERAL DESCRIPTION OF THE PREFERRED EMBODIMENT

Figures 1, 2:
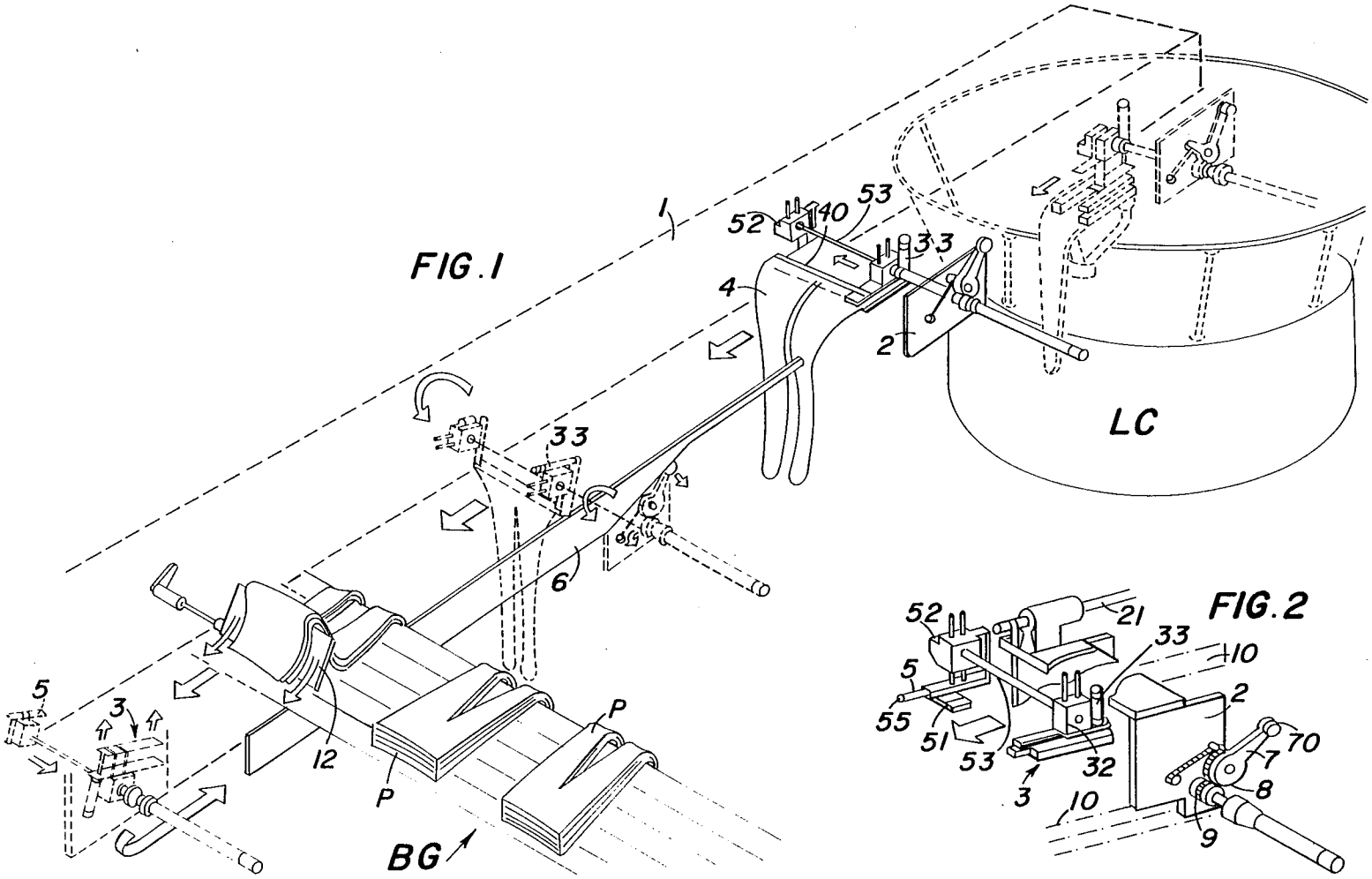
FIG. 1 is a schematic perspective view of an apparatus for transferring pantyhose from a sewing machine to a packing location constructed in accordance with the invention.
FIG. 2 is an enlarged perspective view of a portion of FIG. 1 showing the article-engaging mechanism.
Figure 3A:
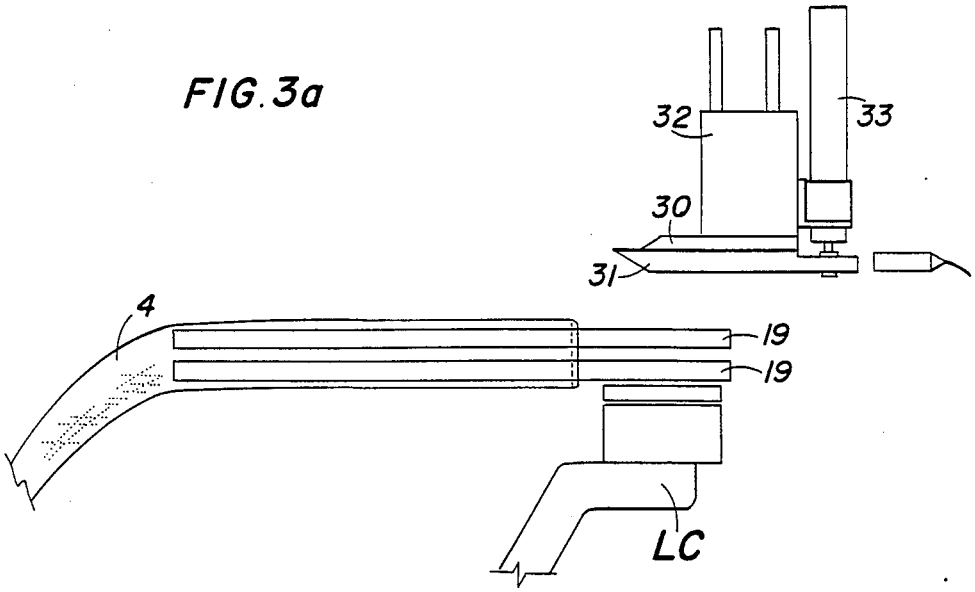
FIG. 3*a* is a partial, side-elevational view indicating the engagement of the article by the grippers.
Figure 3B:
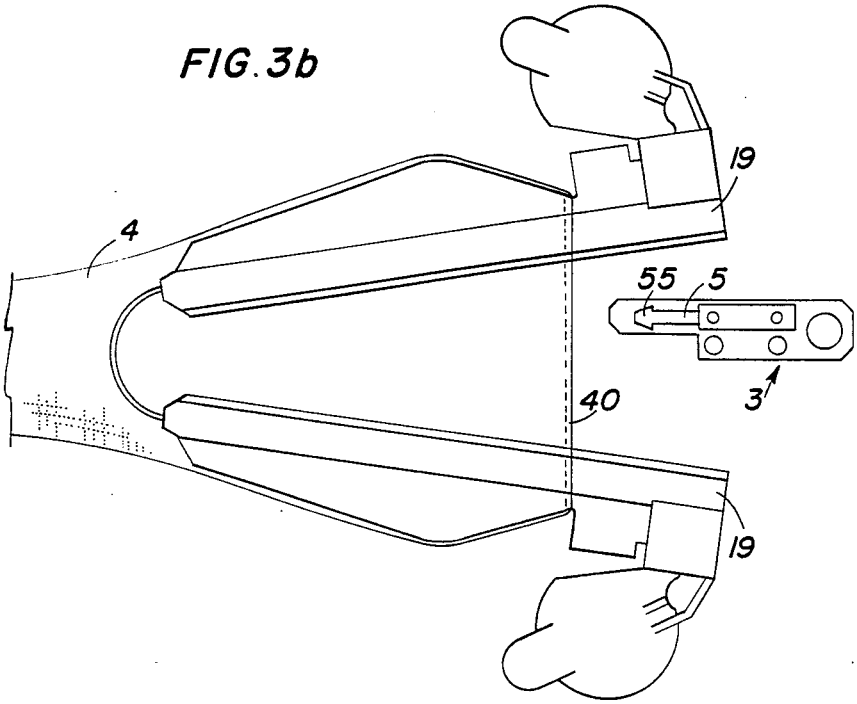
FIG. 3*b* is a top plan view of the device shown in FIG. 3*a;*
Figure 4A:
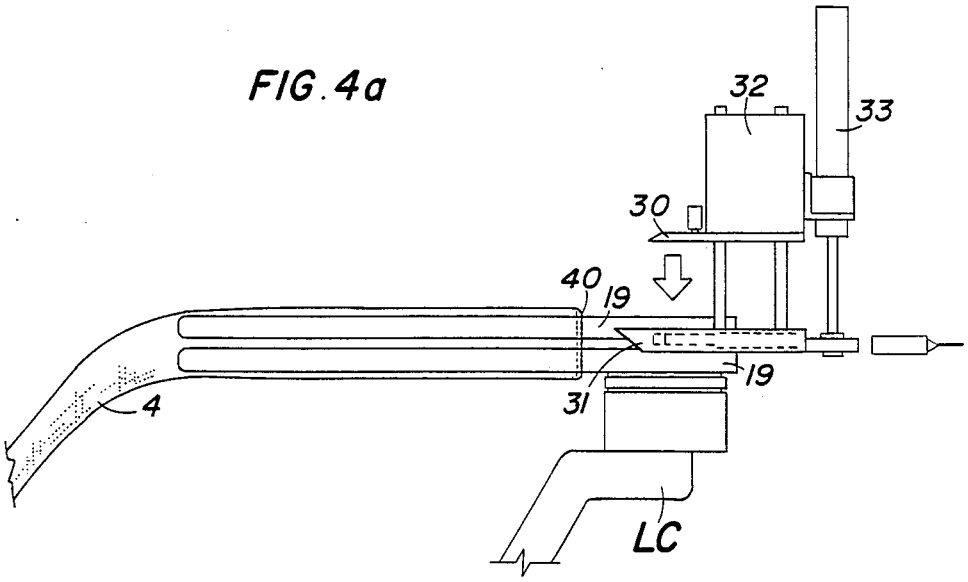
FIG. 4*a* is a side elevational view similar to FIG. 3*a* showing an advanced position of the engagement of the article.
Figure 6A:
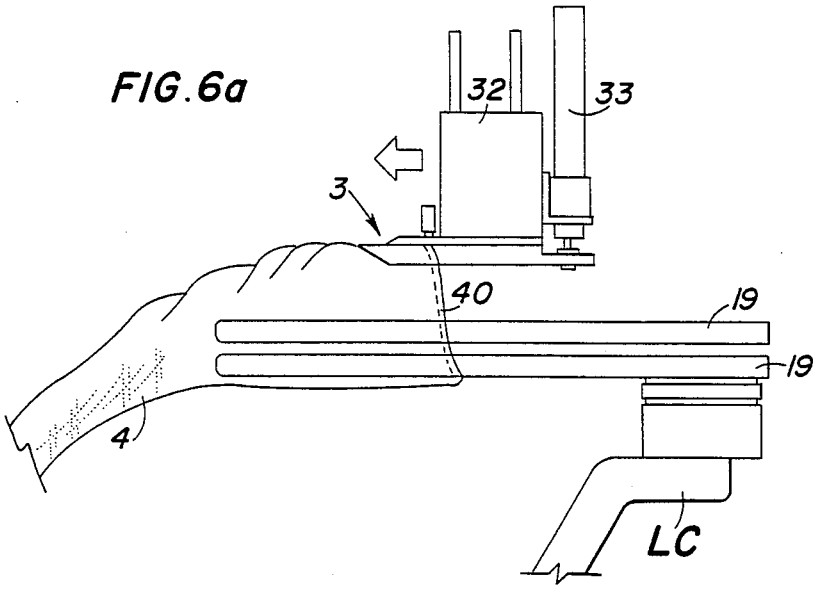
FIG. 6*a* is a view similar to FIG. 3*a* of a still further advanced position of the gripping of the article.
Figure 6B:
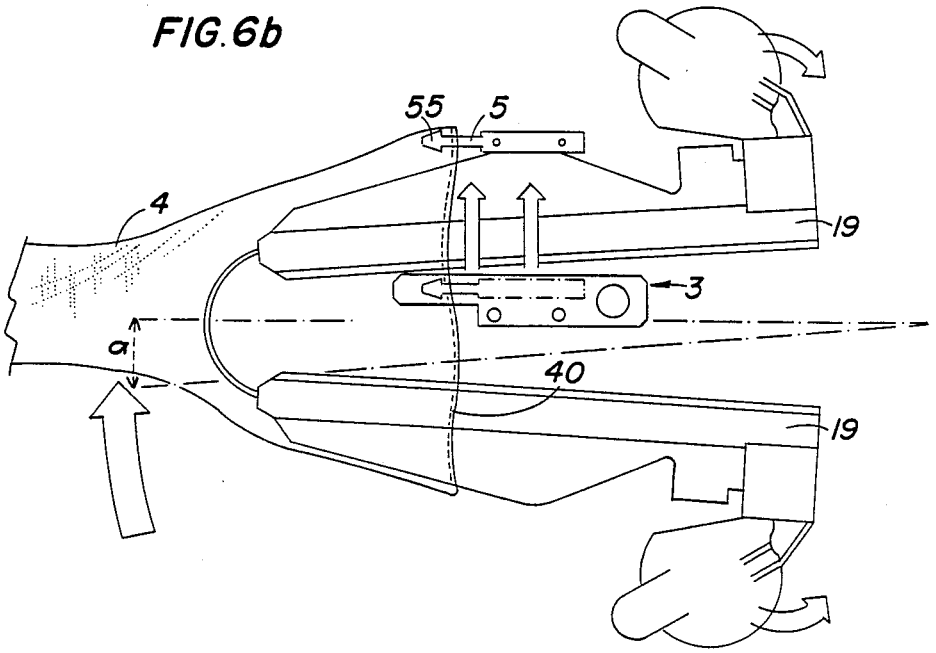
FIG. 6*b* is a top plan view of the position shown in FIG. 6*a;*
Figure 7:
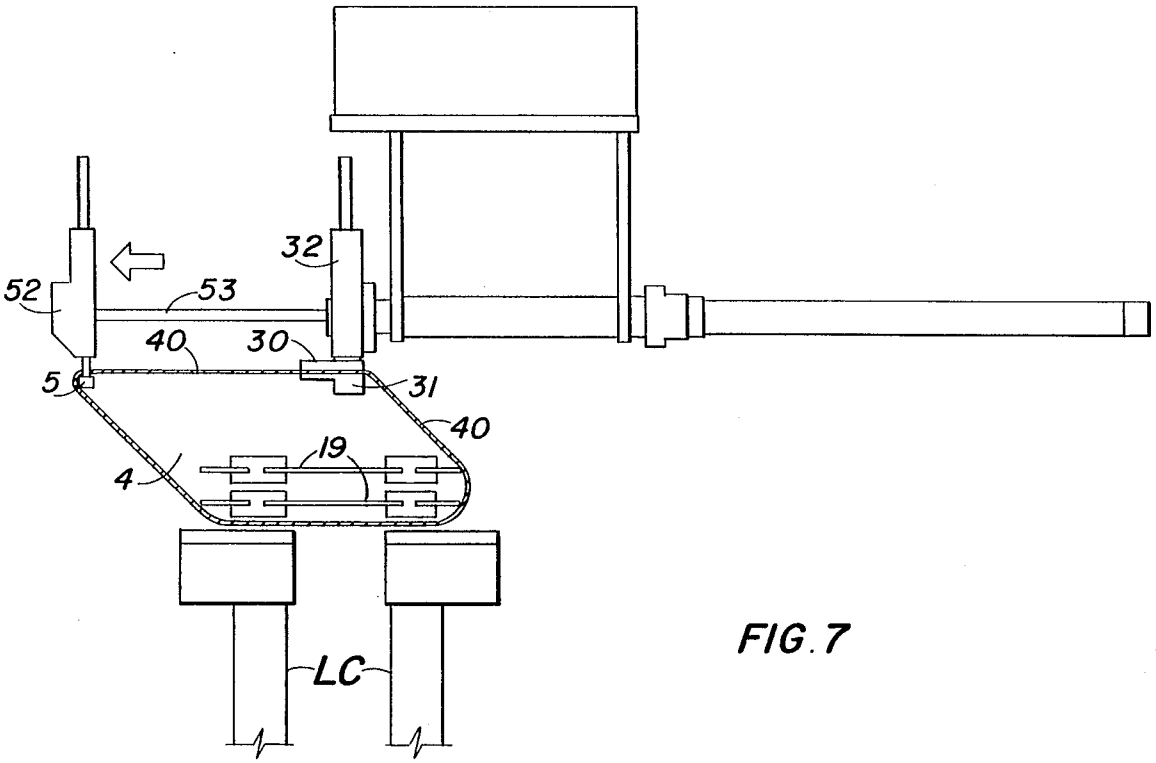
FIG. 7 is a side elevational view of a further advanced position of the movement of the article.

Referring to the drawings, in particular, the invention embodied therein comprises a device for transferring articles such as pantyhose from a sewing machine LC for sewing the articles and which articles have an end opening with an encircling band 40 of elastic material and in this instance comprises pantyhose 4. The device and method comprise the means and the method for moving the article 4 from a sewing machine LC to a packing station which in the embodiment shown comprises a conveyor BG. The pantyhose 4 at the packing station are arranged in a stack P and during their movement they are draped over a substantially vertically extending shelf 12 which overlies the packing station BG which comprises a conveyor. In accordance with the invention, a carriage 2 is movable between the machine LC and the packing conveyor BG and is draped over the substantially vertically arranged shelf 12. For this purpose, an article gripper 3 on a carriage 2 is mounted along with a stylus 5 to the carriage in a manner such that they move laterally or transversely relative to each other. The gripper 3 has a fixed substantially horizontally extending tip 30, as best shown in FIG. 4*a*. A vertically reciprocable or movable tip 31 is movable relative to the fixed tip 30 for engaging into the waistband 40 of the pantyhose 4. A stylus 5 is carried on a block 52 which moves on a horizontal rod 53 of a carriage 2 so that it may spread the article apart as best seen in FIGS. 1 and 6.

Figure 4B:
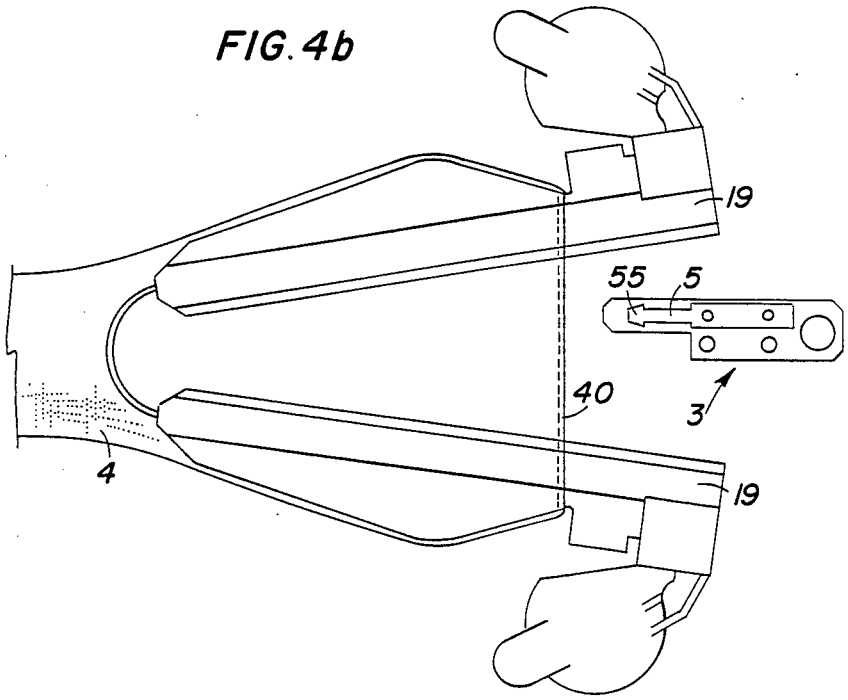
FIG. 4*b* is a top plan view of the device as shown in FIG. 4*a;*
Figure 5A:
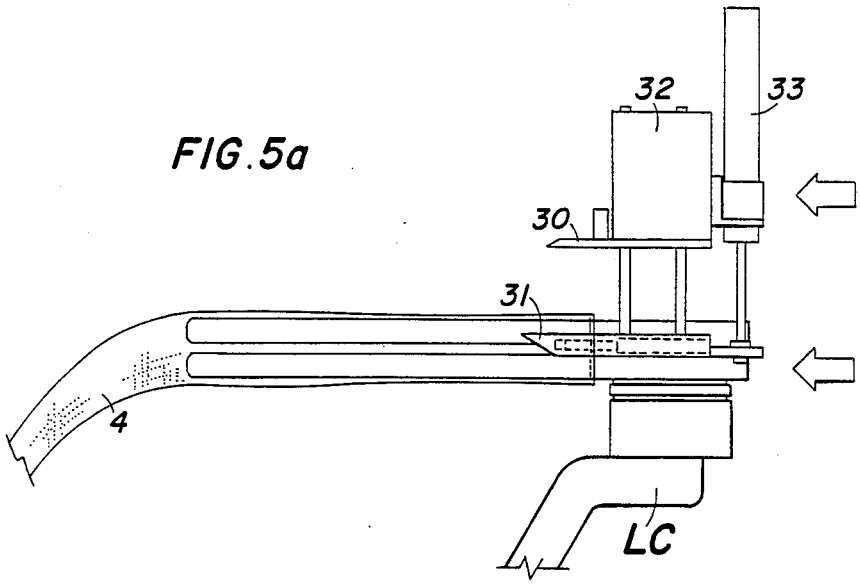
FIG. 5*a* is a view similar to FIG. 3*a* showing a still further advanced position of engagement of the article.
Figure 5B:
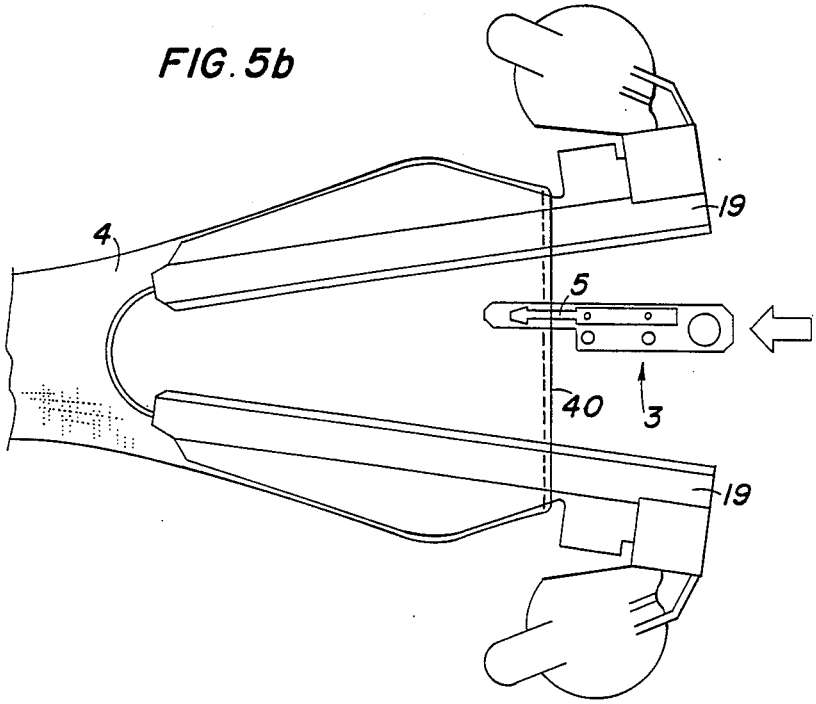
FIG. 5*b* is a top plan view of the apparatus shown in FIG. 5*a;*

Reduced to its essential structure and with reference to the attached drawings, an apparatus for automatically transferring pantyhose articles 4 produced by a pantyhose-sewing machine to a conveyor for packed pantyhose articles according to the invention, comprises a bearing structure 1 with a straight horizontal track 10 extending from the unloading station of a pantyhose machine LC to a loading station of a conveyor BG for packed pantyhose articles P; a carriage 2, with reciprocating motion on said track 10, performing a brief dwell at the dead point in correspondence of the machine LC, and carrying a gripper 3 having flat, parallel and horizontal tips, the one tip indicated by 30 (FIG. 4) being fixed and the other 31 being provided with vertical reciprocating motion in order to grip and hold, at a corresponding point of its upper edge, the elastic band 40 of the pantyhose 4 when the bodies of a pantyhose 4 which is fitted over the shapes or forms 19 of a sewing machine LC, is stretched apart to form a horizontal rectangle and is opened inwardly of the same machine LC. A straight stylus 5 is associated with and is parallel to the tips of gripper 3 and is provided with a reciprocating movement transverse to the gripper. The run of stylus 5 is in a direction away from the gripper while this is stopped for engaging the elastic band of the pantyhose causing the seams 42 of pantyhose 4, which upon completion of the sewing operation result on a same horizontal plane, to be disposed out of the machine LC on a same vertical plane.

Rotation means (FIG. 1) for rotating the gripper 3 and the stylus 5, through approximately 90° about a horizontal axis and during the forward run of the carriage 2, with the elastic band of the pantyhose 4 supported by them and the rest of the pantyhose being in pendent attitude, comprises a cam 6, affixed to the structure 1, a lever 7 with a roller 70 sliding on the cam 6, a sector gear 8 solid to said lever 7, a sprocket 9 meshing with said sector gear 8 and a return spring 11 solid to the gripper 3. The rotation is provided to allow the elastic bodice band at least a portion of the bodice to be oriented and laid on one side of an underlying vertical shelf 12 provided at a loading station of a conveyor BG for the packed pantyhose articles. The disjoined legs of the pantyhose are laid on the other side of said shelf 12, and in such a way that the thus laid pantyhose makes part of a pack (P) of superposed pantyhose articles.

According to further characteristics of the invention, the stylus 5 is associated with a foot 51 vertically sliding within a block 52 mounted at the free end of a horizontal rod 53, coaxial and going through the support 32 of gripper 3 and actuated by an in-line pneumatic cylinder in its dwell state. The foot 51 is transversely located under the gripper 3 so that, upon the activation of the gripper lower tip 31 by means of a corresponding pneumatic cylinder 33, there is obtained the simultaneous lowering of the stylus 5. However, the stylus 5 has a cup-shaped tip to allow the retention of the pantyhose elastic band 40 during its transfer and thus preventing the spontaneous fall thereof.

Figure 11:
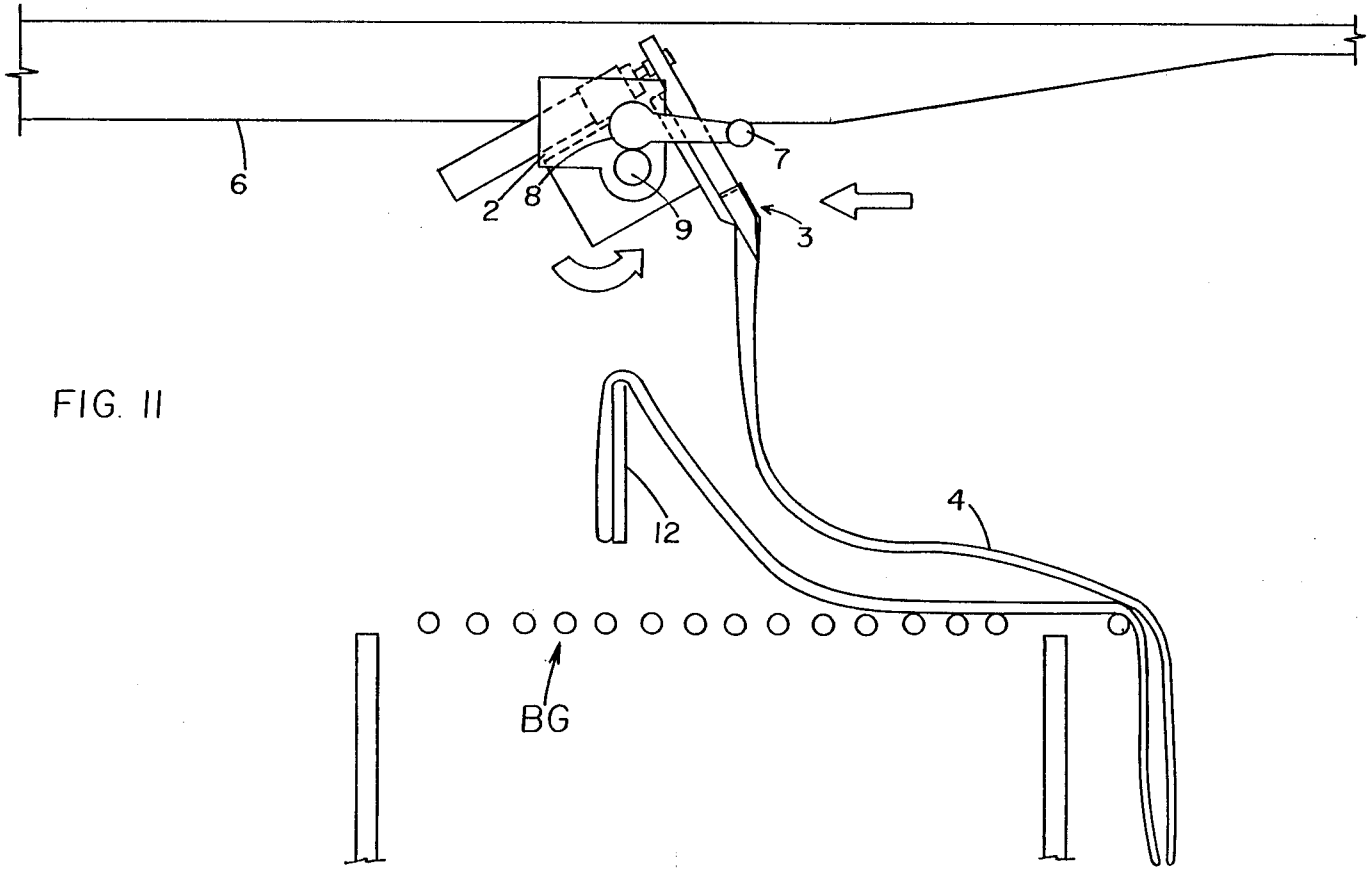
FIG. 11 is a side elevational view of the carriage indicating the rotation thereof during the draping of the article on a vertical shelf over a packing station.
Figure 12:
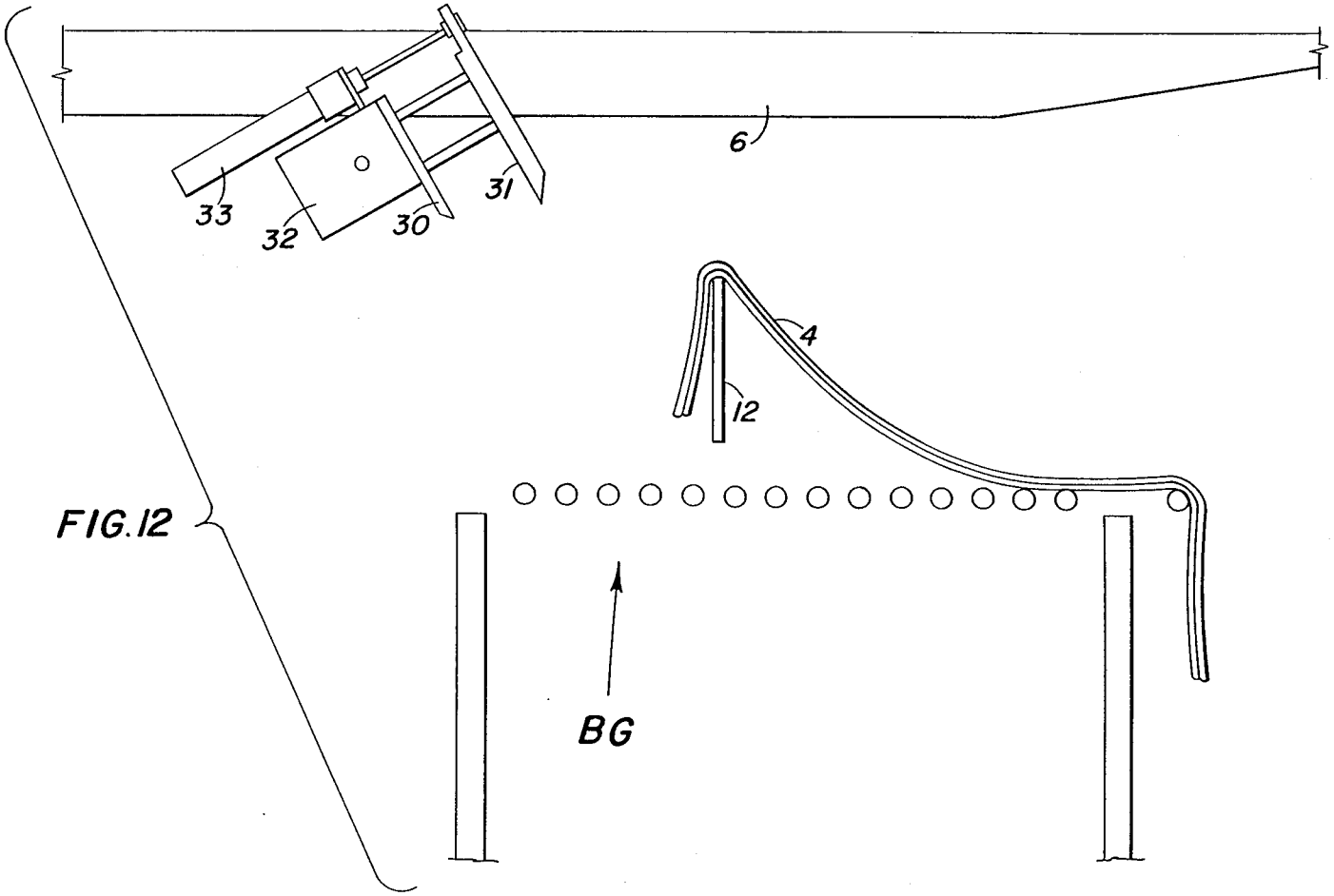
FIG. 12 is a view similar to FIG. 11 showing an advance position of the carriage after the draping of the article over the packing station.

According to another characteristic of the invention, the straight reciprocating movement of carriage 2 is achieved by means of a worm screw 21, disposed horizontal and parallel to the track 10, which is activated by a direct-current motor (not shown) whose intervention is suitably programmed to allow the motion direction to be reversed during the backward run of carriage 2, and the run to be performed at a speed higher than the forward one. The operation is as follows. The pantyhose arrives, after completion of its sewing, at the unloading station of the machine LC, onto the shapes 19 which are wide opened initially and are closed afterwards to bring the two elements 19 of each shape close to one another (FIGS. 3–7) thereby causing the two symmetrical seams 42 to lie on the same horizontal plane (FIG. 9). When the pantyhose 4 arrives at this unloading station of the machine LC, the carriage 2 finds itself at the end of the return run, with the gripper 3 and the stylus 5 being retracted, that is, brought close to one another and in overhead position with respect to the shapes 19 having the pantyhose 4 thereon. Then, the lower tip 31 of gripper 3 and stylus 5 are lowered to position them in front of the pantyhose opening; after which, the carriage 2 begins its forward run. As soon as the lower tip 31 of gripper 3 and the stylus 5 have gone through the pantyhose opening, the lower tip 31 of the gripper 3 and the stylus 5 are lifted to cause the tip 31 to clamp the upper tip 30 of gripper 3, a corresponding point of the elastic band 40 of the pantyhose. Afterwards, the carriage 3, by keeping on with its run toward the conveyor BG, strips the pantyhose from the shapes 19 with the stylus 5, by advancing transversely, causing the band and bodice of the pantyhose to rotate through 90° about its own axis so as to make the two seams 42 lie on a same vertical, that is, median plane as shown in FIG. 10. At about half of the forward run, the lever 7 meets the cam 6 thereby imposing a progressive rotation to the carriage 2 carrying the pantyhose 4 up through 90° or a slightly higher rotation (FIG. 11); after which, the stylus 5 is brought closer to gripper 3 and this is opened to release the elastic band of pantyhose 4 which falls with its elastic band on one side of an underlying vertical shelf 12 provided in the loading station of a conveyor BG for packed pantyhose articles, and with the disjoined legs on the other side of same shelf. Finally, the gripper 3 is re-closed and the stylus 5 gets close to it, and this before or while the carriage 2 performs the idle backward run to reach the starting position.

Practically, the construction details may vary in equivalent way as far as for the form, dimensions and disposition of the elements, and nature of the used materials are concerned, without nevertheless coming out from the scope of the solution idea adopted and thus remaining within the limits of the protection granted by the present patent for industrial invention.

While specific embodiments of the invention have been shown and described in detail to illustrate the application of the principles of the invention, it will be understood that the invention may be embodied otherwise without departing from such principles.

What is claimed is:

1. An apparatus for automatically transferring pantyhose articles having a body portion including an opening with an elastic band and two leg portions and which have spaced-apart seams in said body portion with and unloading station for packing the pantyhose, comprising a sewing machine unloading station, a packing station spaced from said unloading station, a bearing structure including a straight horizontal track extending from said unloading station to said packing station, a carriage movable backwardly and forwardly on said track and provided with a gripper engageable with the elastic band of the pantyhose when the pantyhose is still fitted over a shape portion of the sewing machine so that the opening of the pantyhose around the elastic band is turned inwardly of the sewing machine, a stylus on said carriage relatively moveable apart with respect to said gripper, said gripper lying in a vertical plane, to orient the pantyhose elastic band while the elastic band is held by said gripper with the seams of the pantyhose substantially on the vertical plane, rotation means including a cam fixed on said bearing structure for rotating said elastic band of thus oriented pantyhose about a horizontal axis, a lever with a roller sliding on said cam, a sector gear affixed to said lever and engaged with a gear on said cam shaft, a return spring affixed to said gripper, a shelf underlying said gripper engageable against the pantyhose for allowing the pantyhose to be oriented so as to lay the elastic band on one side of said underlying shelf over said unloading station with the leg portions of said pantyhose on the other side of said shelf.

2. An apparatus according to claim 1, including drive means driving said carriage including a worm screw which may be driven forward and backwardly and at a higher speed in a backward return direction.

3. An apparatus according to claim 1, wherein said gripper includes a first tip which is fixed and a second tip which is movable relative to said first tip, said tips being stretchable apart from the pantyhose and then clamped after penetration of one of the tips in the opening of said pantyhose so as to engage the elastic band, a stylus carried by said gripper being movable apart from said gripper to stretch the elastic band.

4. An apparatus according to claim 2, wherein the gripper includes a foot associated with said stylus, the foot being receivable under said gripper and including a spring biasing said stylus to a return position.

5. An apparatus according to claim 1, including a pneumatic cylinder connected to said stylus and moving said stylus toward and away from said gripper.

6. An apparatus according to claim 1, wherein said stylus comprises a cup-shaped member engageable against the elastic band of the pantyhose to insure that the pantyhose remains entrained by said stylus.

7. A device for transferring articles from a machine for sewing the articles, said articles having an interior and an exterior and having an opening with an elastic band adjacent the opening, in order to move the articles from an unloading station of a sewing machine to a packing station, comprising a packing station, a substantially vertically extending shelf positioned over said packing station, a carriage movable between the unloading station of the sewing machine and said packing station over said shelf, an article gripper on said carriage, a stylus on said carriage movable toward and away from said gripper, said gripper having a fixed substantially horizontally extending tip engageable over the exterior of the article and a movable tip engageable into the opening of the band of the article, said gripper and said stylus being rotatable with said carriage after said stylus and said movable tip are engaged in the elastic band of the article so as to rotate the article to position the article in a pendent pending position at least so that a freely hanging portion thereof engages over said shelf so that the article is draped in a stack at said packing station beneath said shelf.

8. A device according to claim 7, wherein the shelf is movable outwardly from under the article as the article is positioned at the stacking station.

9. A device according to claim 7, wherein said gripper includes a fixed gripper portion and a movable gripper portion which are relatively movable toward and away from each other.

10. A device according to claim 7, wherein said carriage includes a support arm, a gripper and said stylus being mounted on said support arm and being movable toward and away from each other relatively.

11. A method of transferring pantyhose articles, having an encircling elastic band and two leg portions depending from a body portion containing the band, to a stacking station comprising arranging the pantyhose so that they are stretched on a form of a sewing machine leaving the opening between the band opened at one end, moving a carriage including a gripper member and a stylus so that the gripper member includes a gripper portion entering into the opening of the article, moving the stylus away from the gripper member so as to spread the article apart, moving the carriage with the gripper member and the stylus carrying the article so that the article depends from the gripper member, moving the article through a path intercepting a vertically arranged shelf so as to drape an upper portion of the pantyhose article over the shelf, and moving the shelf outwardly from under the article as to permit the article leg portions to drape over a stacking area and to deposit the body portion of the article in a stack on the stacking area.

12. A method according to claim 11, wherein the carriage carrying the gripper and the stylus is movable in a path away from the sewing machine and is rotatable to effect the draping of the article over the shelf.

13. A method according to claim 11, wherein the pantyhose article is initially positioned on the form of the sewing machine so that the leg portions are folded one over the other and wherein the stylus and the gripper are moved apart after they engage in the opening of the article to stretch the waistband area apart.

* * * * *